United States Patent [19]

Worback

[11] 4,065,010

[45] * Dec. 27, 1977

[54] SWING VALVE CIRCUIT

[75] Inventor: David L. Worback, Highland, Mich.

[73] Assignee: Massey-Ferguson Inc., Detroit, Mich.

[ * ] Notice: The portion of the term of this patent subsequent to Feb. 15, 1994, has been disclaimed.

[21] Appl. No.: 654,675

[22] Filed: Feb. 2, 1976

Related U.S. Application Data

[63] Continuation-in-part of Ser. No. 559,271, March 17, 1975, Pat. No. 4,007,845.

[51] Int. Cl.[2] ..... E02F 3/32

[52] U.S. Cl. ..... 214/138 D; 91/420; 91/454

[58] Field of Search ..... 214/138 D, 138 R; 91/412, 420, 454, 183, 186

[56] References Cited

U.S. PATENT DOCUMENTS

| | | | |
|---|---|---|---|
| 3,033,170 | 5/1962 | Norton et al. | 91/454 |
| 3,047,171 | 7/1962 | Long | 214/138 D |
| 3,795,178 | 3/1974 | Roche | 91/420 |
| 3,922,855 | 12/1975 | Bridwell et al. | 214/138 R |
| 3,960,286 | 6/1976 | Spooner et al. | 91/412 |

*Primary Examiner*—Robert J. Spar
*Assistant Examiner*—Ross Weaver
*Attorney, Agent, or Firm*—Thomas P. Lewandowski

[57] ABSTRACT

Control for a swing mechanism having linear actuators such as hydraulic cylinders connected to the swing mechanism in a manner whereby the actuators work in unison with each other over a portion of the swing of the swing mechanism and in opposition to each other over another portion of the swing when imparting arcuate motion to the swing mechanism with the linear motion of the actuators. The control includes a pressure reducing-metering valve and a metering valve in each of two sets of lines which supply and return pressurized fluid to the actuators. The respective valves limit the pressure of fluid to one actuator while requiring a predetermined minimum actuation pressure to provide a more constant speed and torque characteristic for the swing mechanism. A check valve is placed in a line interconnecting the head end of one actuator and the rod end of the other actuator to prevent a regenerative effect occurring from interaction of the actuators, and pilot lines to the metering valves can be provided with orifice sets to damp the signal to the metering valves.

24 Claims, 1 Drawing Figure

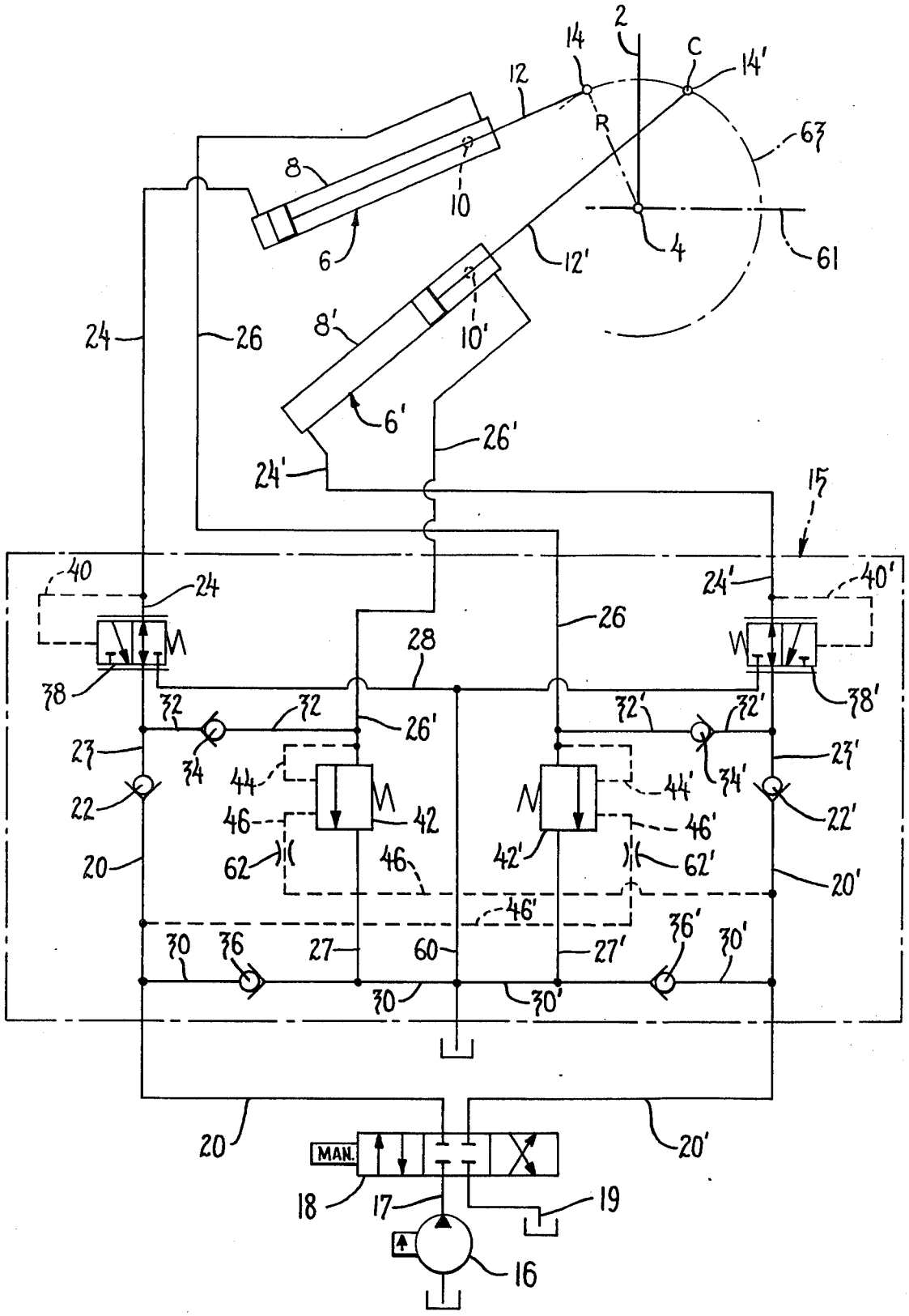
2
14
C
14'
12
R
63
8
10
6
4
61
12'
8'
10'
24
26
6'
26'
24'
15
40
24
24'
40'
26
28
38
38'
32
32
26'
32'
32'
23
34
44
44'
34'
23'
22
46
42
42'
46'
22'
62
46
62'
20
20'
46'
30
36
27
60
27'
36'
30'
30
30'
20
20'
MAN.
18
17
19
16

SWING VALVE CIRCUIT

This is a Continuation-In-Part of application Ser. No. 559,271 filed Mar. 17, 1975 now U.S. Pat. No. 4,007,845 and incorporates as a part hereof the subject matter disclosed therein. It discloses an invention relating generally to a backhoe and is particularly concerned with apparatus for controlling the side to side swinging movement of a backhoe boom or like type machine.

The above noted parent patent discloses the geometry of the present system which includes a pair of linear cylinders as actuators for swinging a member such as a backhoe boom mounted on a swing unit in such manner that the boom can be actuated by an operator to swing from side to side to position the boom at a desired location in a horizontal path for digging purposes. As pointed out in the disclosure, its control circuit is a simplification over the complex circuitry of presently manufactured equipment for control of swinging movement.

In the present invention a way of plumbing the controls has been devised to further simplify its circuit over the above noted parent application which took the general approach of isolating each valve in the circuit from all the other valves. Thus, use of a combination valve eliminates one of the valves of the parent application.

The change in plumbing gives rise to the possibility of a regenerative effect occurring which the present control overcomes with check valve in a line interconnecting the lines to the head end of one actuator with the rod end of another actuator.

It was found useful to incorporate an orifice in the pilot line of a metering valve to thereby damp the signal to the valve and eliminate premature operation of the valve.

The present invention includes a power source such as a pump to supply pressurized fluid to power means such as hydraulic cylinders connected to a swing member, for example a backhoe swing casting, swingable in opposite directions in response to flow of hydraulic fluid in opposite directions to and from the power means. At least one pair of hydraulic lines conduct the fluid to and from the power means. Flow of fluid to the power means in one of the lines causes the swing member to swing in one direction and flow in the other line causes swinging in the other direction. A pressure reducing metering valve in the one line limits pressure to the power means through the one line to a predetermined maximum pressure when the swing member moves in one direction, and meters fluid from the power means upon overriding of the movement of the swing member in the other direction above a predetermined maximum pressure. A metering valve is operable to permit flow of fluid from the power means through the other line during the swinging movement of the swing member only when a predetermined minimum pressure exists in the one line or a predetermined maximum pressure exists in the other line.

With one of the lines connected to the head end of one of the cylinders and the other line connected to the rod end of the other cylinder, an interconnecting line between the pair of lines with a check valve in it prevents flow from the rod end of the other cylinder to the head end of the one cylinder while still permitting flow from the power source to the rod end of the other cylinder and from the head end of the one cylinder to the rod end of the other cylinder. Thus, a regenerative effect, resulting from flow to the head from the rod end of the other cylinder. is prevented on the head end by preventing flow from the rod end of the other cylinder.

Further, a pilot line for said metering valve connected to sense the pressure in the one line has a metering orifice in it to prevent premature operation of the valve under sudden peak loads or drop in pressure.

The above advantages of the invention will become readily apparent to one skilled in the art from reading the following detailed description of an embodiment of the invention when considered in light of the accompanying drawing in which:

FIG. 1 is a schematic of a system and controls incorporating an embodiment of the present invention.

Referring to FIG. 1 a hydraulic system indicated collectively by reference numeral 15 is illustrated with common reference numerals identifying common components to those of FIG. 2 of the parent application unless otherwise identified.

The geometry of the power means 6, 6' and swing bracket 2 of FIG. 1 of the parent application is the same for the present application and, therefore, FIG. 1 of the parent application is not repeated herein. The first five pages of the parent application fully describe the purpose of the particular embodiment disclosed in FIG. 1 thereof. On pages 10–13 and 14–15of the parent application the function of the above geometry is disclosed and not repeated here.

Returning to FIG. 1 of the present application, the supportive components to the hydraulic system disclosed, such as the pump 16 and directional valve 18 etc., are also as disclosed in the parent application. Turning to the circuit disclosed, line 20 is connected via a check valve 22 with one end of a supply line 23, the other end of line 23 being connected with a head end line 24 to the head end of actuator 6. The rod end of actuator 6 is connected with a rod end line 26. Similarly, line 20' is connected via a check valve 22'0 with a supply line 23' and a head end line 24' to the head end of actuator 6', the rod end of actuator 6' being connected with a rod end line 26'.

Actuation of the directional valve 18 to the right or left from the neutral position shown in FIG. 1 energizes the hydraulic circuit 15 to supply fluid either to the head end of actuator 6 or to the head end of actuator 6'. When valve 18 is actuated to the right in FIG. 1, fluid is supplied to the head end of actuator 6 and to the rod end of actuator 6' resulting in clockwise swinging movement of the swing bracket 2 (illustrated only by its axis). Conversely, actuation of valve 18 to the left in FIG. 1 causes fluid to be supplied from pump 16 to the head end of actuator 6' and rod end of actuator 6 which results in counterclockwise swinging movement of the swing bracket 2.

When fluid pressure is supplied to the head end of one of the actuators 6 or 6', the actuator is urged to extend by the head end fluid pressure. Conversely, when fluid pressure is supplied to the rod end of one of the actuators 6 or 6', the rod end fluid pressure urges the actuator to retract. However, when one of the actuators is in an overcenter position with respect to the axis of support member 4 so that its line of force is on the same side of support member 4 as that of the other actuator, the swing bracket 2 will prevent movement of the actuator in the direction urged by the fluid pressure acting on the actuator until the actuator moves from the overcenter position to the opposite side of the swing axis, i.e. the axis of the swing bracket support member 4.

A cross line 30 extends between lines 20 and 20', and lines 26 and 26' are connected with the cross line 30 through drain lines 27 and 27'. Lines 24 and 24' are connected with the cross line 30 through head end drain line 28. Line 26 is connected with lines 20' and 24' through line 23' by interconnecting line 32' bypassing line 27' and controlled by a check valve 34'. Similarly, line 26' is connected with lines 20 and 24 through line 23 by interconnecting line 32 controlled by a check valve 34 and bypassing line 27. A first exhaust check valve 36 is located in line 30 between its connection with line 20 and its connection with line 27. Similarly, a second exhaust check valve 36' is located in line 30' between its connection with line 27' and its connection wth line 20'.

The flow to the head end of actuator 6 through line 24 is controlled by a normally open pressure reducing metering valve 38 which limits the pressure in line 24 to a predetermined maximum by closing to shut off flow to line 24 from line 23 when the predetermined maximum pressure exists in line 24. The pressure reducing metering valve 38 is controlled by a pilot pressure in a pilot line 40 connected with line 24 so as to sense the pressure at the head end of actuator 6. When line 20 is connected with the supply line 17, the pressure reducing metering valve 38 begins to meter the flow to line 24 when the pressure approaches a predetermined maximum, and shuts off the flow to line 24 when the pressure, as sensed through the pilot line 40, exceeds the predetermined maximum pressure. A similar pressure reducing metering valve 38' controls the pressure of hydraulic fluid to the head end of actuator 6' through line 24'.

Line 26 is controlled by a normally closed rod end metering valve 42'. Valve 42' is connected through a pilot line 44' with line 26, and through a pilot line 46' with line 20. If the pressure in the pilot lines 44' or 46' reaches a predetermined value to overcome the spring force biasing valve 42 to its closed position, valve 42 will begin to open and permit flow from the rod end of actuator 6 through lines 26 and 27' to line 30.

Line 28 is controlled by the pressure reducing metering valve 38 which has a metering as well as a pressure reducing function and has the pilot line 40 also connected with the metering function. When a predetermined pressure is reached in pilot line 40 the valve 38 overcomes the spring force biasing it to close its port to line 28 and begins to open permitting flow through line 28 from valve 38 to line 60 from line 24.

Flow through valve 38 from line 23 to line 24 occurs at a lower pressure than when flow is being forced from the head end of actuator 6 into line 28 from line 24. When flow is from line 24 to line 28 the port of valve 38 connected to line 23 is blocked off.

Similarly metering valve 42 and pressure reducing metering valve 38' control line 26' and line 28 in conjunction with line 24', respectively.

A normal operating cycle for the hydraulic system 15 when swinging the swing mechanism clockwise will now be described.

The directional valve 18 is shifted to the right supplying pressure fluid from line 17 to line 20 and connecting line 20' to sump. Check valve 22 opens and flow enters both line 23 and interconnecting line 32. The flow in interconnecting line 32 crosses check valve 34 to pressurize line 26' and the rod end of actuator 6'. Since the pressure reducing metering valve 38 is a normally open valve, flow also crosses it to pressurize line 24 and the head end of actuator 6. In its first mode of operation, the pressure reducing metering valve 38 senses the pressure in line 24 through pilot line 40 and limits the pressure in line 24 to a predetermined level by restricting the amount of flow across it. At the same time the pressure in line 20 is transmitted through pilot line 46' to valve 42 which is normally closed thereby starting it to open when a predetermined minimum pressure is reached in line 20. The opening of valve 42' permits return of fluid from the rod end of actuator 6 through line 26 to line 27' which is connected to sump by lines 30 and 20' with flow being free to pass over check valve 36'. Check valve 36 in line 30 prevents flow from the line 20, which is acting as the supply line, from dumping to sump. Flow to sump may also return via lines 30 and 60. Before the actuator 6' crosses over the swing axis of support member 4, the actuator 6' acts as a pump because its rod 12' is being extended while pressure fluid is supplied to the rod end of the actuator through line 26'. The resulting pressure rise in line 26' is sensed by virtue of pilot line 44 causing metering valve 42 to open thereby permitting flow from line 26' to lines 27 and 30 to return to sump as described above. Check valve 34 prevents flow across interconnecting line 32 into the head end of actuator 6 preventing a regenerative effect.

After actuator 6' crosses the swing axis of support member 4, the actuators both act as motors and cooperate to further swing the swing bracket 2 about the support member 4. In the motor mode, actuator 6 is extending while actuator 6' is retracting. Discharging fluid from actuator 6' is returned via line 24' across pressure reducing metering valve 38', which is open because pilot line 40' is not pressurized, to lines 23' and 32' across check valve 34' to line 26. The discharging fluid from actuator 6' is joined by fluid discharging from the rod end of actuator 6 via line 26 with the combined flows passing through valve 42'. Fluid from line 26 is metered by metering valve 42' which is opened by pilot line 46' being pressurized by line 20 which is acting as the supply line. Thus fluid from the head end of actuator 6' passes from line 26 across metering valve 42' to lines 27 and 30 in turn connected to sump.

As the actuator 6 crosses the swing axis of support member 4, its rod 12 is caused to contract making it act as a pump with pressure fluid being supplied to line 24. The resulting pressure rise in line 24 is sensed by pilot line 40 and is sufficient to place the pressure reducing metering valve 38 in its second mode of operation wherein line 24 is connected with line 28 to dump the fluid in the head end of actuator 6 to sump via line 60.

With either actuator in the pump mode of operation, it will be appreciated that centering of the directional valve 18 to stop swing bracket 2 movement will result in the pump mode actuator providing control to overcome enertia of the swing casting and its apendages such as the boom. When both actuators are in the motor mode of operation, the enertia will cause a pressure drop in lines 24 and 20 resulting in a pressure loss signaling via pilot line 46', the closing of metering valve 42' which can only open again if the enertia is sufficient to open the metering valve 42' against a high relief pressure as sensed by pilot line 44' in line 26 through which fluid would be exhausted.

Since the hydraulic system 15 is symmetrical, movement of the directional valve 18 to the left in FIG. 1 reverses the above functions for metering valves 42 and 42' and pressure reducing meter valves 38 and 38'.

Cavitation is prevented at the rod end of actuator 6 during contracting movement of actuator 6 by the flow of fluid from the sump through line 60 to line 30, past check valve 36′ to line 20′ and from line 20′ across check valve 22′ through lines 23 and 32′ past check valve 34′ to line 26. Similarly, cavitation is prevented at the rod end of actuator 6′ during contracting movement of actuator 6′ by the suction of fluid from the sump through line 60 to line 30 past check valve 36 to line 20, and from line 20 across check valve 22 through lines 23 and 32 past check valve 34 to line 26′.

Cavitation at the head end of actuator 6 during extending movement thereof is prevented by the suction of fluid from the sump through line 60 to line 30, and from line 30 past check valve 36 to line 20, and from line 20 past check valve 22 to line 24. Cavitation at the head end of actuator 6′ during extending movement thereof is prevented by the suction of fluid from the sump through line 60 to line 30, past check valve 36′ to line 20′, and past check valve 22′ to line 24′.

Valves 42, 42′ and 38, 38′ can function as relief valves when the directional valve 18 is returned from its actuated to the neutral position illustrated in the drawing, with line 30 being connected through line 60 to sump. Valves 38 and 38′, for example, may be set to open to line 28 when the head end pressure, as sensed by pilot lines 40 and 40′, reaches approximately 2200 psi. Valves 42 and 42′, may, for example, be set to open when the pressure in lines 26 and 26′, as sensed by pilot lines 44 and 44′, reaches a predetermined maximum such as 3500 psi. The foregoing specific pressures are given by way of example only, and are not to be construed as limitations. It is apparent that the pistons of the actuators 6 and 6′ have differential areas on their head end and rod end sides, the effective area on the rod end side being reduced by the area of the rods 12 and 12′. The specific differential area between the head and rod side of the actuator piston must therefore be taken into account to obtain a constant force and enable the swing bracket 2 to return on the same torque curve that it is initially swung on. The resulting torque curve has a torque value that is substantially the same for a given swing bracket 2 position regardless of the direction of travel of the swing bracket 2. The above curve is accomplished by compensating the pressure on the head side of the extending actuator 6 or 6′ to obtain a head side force matching the force of the rod side. This applies to both actuators, and results from a pressure reduction in the powering mode and a pressure relief in the pumping mode.

It was found that the use of metering orifices 62 and 62′ in the pilot lines 46 and 46′ of the metering valves 42 and 42′ prevented premature opening or closing of the metering valves 42 and 42′ upon the occurrence of sudden peak loads or loss of pressure in the hydraulic system 15.

The system of this invention provides improved torque control and reduced peak torque loads. The pressure is controlled in the system in all operating conditions to minimize the occurrence of conditions that are favorable to cavitation. Smooth torque control is provided when the system is energized to swing the swing bracket, and external shock loads are relieved by the valves 42, 42′, 38 and 38′ to prevent the occurrence of excessive pressures in the system from such external shock loads.

An advantage of the present system is that, for a given setting of the directional valve, the velocity of the swing bracket 2 is reduced at the end positions prior to any cushioning. Since the flow for a given directional valve setting is constant the velocity can only be varied where one actuator (the one acting as a pump) dumps to sump to reduce the flow and slow the swing. This is accomplished by a metering valve, for example, valve 42′ for actuator 6′ in position *c* of FIG. 2 for clockwise motion.

While the invention has been described specifically in connection with backhoe swing apparatus, it is apparent that the invention is suitable for other uses, and particularly with other apparatus having a swinging boom. Therefore, terms and phrases, such as "backhoe" and "backhoe swing apparatus" as used herein, mean any such apparatus having a boom, or the like, that is normally hydraulically operated.

While a specific embodiment of the invention has been illustrated and described in the foregoing specification and accompanying drawings, it should be understood that the invention is not limited to the exact construction shown, but that various alterations in the construction and arrangement of parts is possible without departing from the scope and the spirit of the invention.

I claim:

1. Control for a swing member mounted for side-to-side swinging movement having power means connected with the swing member for causing the swing member to swing in opposite directions in response to flow of fluid in opposite directions to and from the power means including at least one pair of lines for conducting fluid to and from the power means; the swing member being responsive to flow of fluid to said power means in one of said lines to swing in one direction, and responsive to flow of fluid to the power means in the other of said lines to swing in the opposite direction; a pressure reducing metering valve controlling one of said lines, said pressure reducing metering valve being operable to limit pressure to the power means through said one line to a predetermined maximum pressure upon movement of the swing member in one direction, and to meter fluid from the power means through said one line upon movement of the swing member in opposition to fluid supplied to the power means, and a metering valve operable to permit flow of fluid from said power means through said other line during the swinging movement of the swing member only when a predetermined minimum pressure exists in one of said lines.

2. Apparatus as claimed in claim 1 wherein said one line includes as a portion thereof a supply line, said pressure reducing metering valve being mounted in said supply line to control pressure in said one hydraulic line.

3. Apparatus as claimed in claim 1 including a head end drain line connected with said pressure reducing metering valve and connected at the other end to sump.

4. Apparatus as claimed in claim 1 including a drain line connected with said other hydraulic line by said metering valve, said metering valve controlling the flow from said other line into said drain line.

5. Apparatus as claimed in claim 1 including an interconnecting line connecting said one with said other hydraulic line, said interconnecting line providing a discharge for said power means, and a check valve in said interconnecting line permitting flow to said other line, but preventing flow from said other line to said one line.

6. Apparatus as claimed in claim 2 including a check valve in said supply line permitting flow to the head end of said power means through said supply line, but preventing flow from the head end of said power means through said supply line.

7. Apparatus as claimed in claim 2 wherein said one line includes as a portion thereof a first main intake and exhaust line connected with said supply line, a second main intake and exhaust line connected with said rod end intake line, a cross line connecting said first and second main intake and exhaust lines, a first exhaust check valve permitting flow from said cross line to said first main intake and exhaust line but preventing flow to said cross line from said first main intake and exhaust line, and a second exhaust check valve permitting flow from said cross line to said second main intake and exhaust line but preventing flow to said cross line from said second main intake and exhaust line, said drain line being connected with said cross line between said first and second exhaust check valves.

8. Apparatus as claimed in claim 2 wherein said pressure reducing metering valve is biased to a normally open position, said pressure reducing metering valve having a pilot line connected to sense the pressure in said one hydraulic line between said reducing metering valve and said power means, said pressure reducing metering valve being responsive to a predetermined maximum pressure to move to a closed position from said normally open position.

9. Apparatus as claimed in claim 1 wherein said metering valve is biased to a normally closed position, and is responsive to a predetermined pressure in said one line to move to an open position from said normally closed position.

10. Apparatus as claimed in claim 1 including a pilot line for said metering valve connected with said one line, and a second pilot line for said metering valve connected to sense the pressure in said other hydraulic line.

11. Apparatus as claimed in claim 2 wherein said one line also includes an intake and exhaust line connected to said supply line and a check valve, said check valve in the connection between said supply line and intake and exhaust line and including a pilot line for said metering valve connected with said intake and exhaust line.

12. Swing apparatus having a swing member pivotally mounted for side-to-side swinging movement, a pair of extensible and contractable hydraulic actuators, each of said actuators including a cylinder, a piston slidably received in said cylinder, and a rod projecting from said piston through one end of said cylinder, said one end of said cylinder defining the rod end of said cylinder and the other end of said cylinder defining the head end of said cylinder such that flow of hydraulic fluid to the head end of each cylinder causes extension thereof and flow of hydraulic fluid to the rod end of each cylinder causes retraction thereof, a hydraulic power source for supplying fluid to and from the cylinders, and including a control system comprising: at least one pair of lines for conducting fluid to and from the cylinders, one of said lines connected to the head end of one of said cylinders and the other of said lines connected to the rod end of the other of said cylinders, an interconnecting line between said one and said other lines and a check valve in said interconnecting line preventing flow from the rod end of said other cylinder to the head end of said one cylinder, while permitting flow from said hydraulic power source and the head end of said one cylinder to said rod end of said other cylinder through said other line.

13. Control for a swing member mounted for side-to-side swinging movement having power means connected with the swing member for causing the swing member to swing in opposite directions in response to flow of fluid in opposite directions to and from the power means, comprising: a system for controlling flow from the power means including at least one pair of lines for conducting fluid to and from the power means; the swing member being responsive to flow of hydraulic fluid to said power means in one of said lines to swing in one direction; and responsive to flow of hydraulic fluid to the power means in the other of said lines to swing in the opposite direction; a metering valve operable to permit flow of fluid from said power means at a variable rate through said other line during the swinging movement of the swing member only when a predetermined minimum pressure exists in one of said lines, a pilot line for said metering valve connected to sense the pressure in said one line, and a metering orifice in said pilot line to prevent premature operation of said metering valve under sudden peak loads and loss of pressure.

14. In swing apparatus having a swing bracket support member, a swing bracket mounted on said swing bracket support member for side-to-side swing movement with respect thereto, power means connected with said swing bracket for causing said swing bracket to swing in opposite directions with respect to said swing bracket support member in response to flow of fluid in opposite directions to and from said power means, a control system for controlling flow to and from said power means comprising: a first and second pair of lines for conducting fluid to and from said power means, one of said lines directing flow to said power means to swing said swing bracket in one direction and the other of said lines directing flow to said power means to swing said swing bracket in the opposite direction, a first pressure reducing valve controlling said first one line and a second pressure reducing valve controlling said second one line, pilot lines connected to said one lines and to said reducing valves to pressurize said reducing valves toward a closed position to limit pressure to said power means through said one lines to a predetermined maximum pressure, first and second metering valves operable to permit flow of fluid from said power means through said first and second other lines, respectively, during swing movement of said swing bracket, pilot lines connected to said metering valves, said first and second one lines including as portions thereof first and second supply and intake and exhaust lines, respectively, said supply lines connected to said one lines through said reducing valves and to said intake and exhaust lines, check valves connecting said supply lines with said intake and exhaust lines, said metering valve pilot lines being connected to said intake and exhaust lines, respectively, to move said metering valves toward an open position only when a predetermined minimum pressure exists in said intake and exhaust lines, respectively, interconnecting lines and check valves in said interconnecting lines, said interconnecting lines interconnecting said first and second said one and other lines, respectively, to permit flow from said one lines to said other lines and prevent reverse flow, and cross lines connecting said intake and exhaust lines, respectively, exhaust check valves therein permitting flow from said cross lines to said intake and exhaust lines, respectively, but preventing flow to said cross line from said intake and exhaust lines, respectively, and drain lines connecting said other lines, respectively, to said cross lines between said exhaust check valves.

15. Swing apparatus having a swing member pivotally mounted for side-to side swinging movement, a pair of extensible and contractable fluid actuators, each of said actuators including a cylinder, a piston slidably received in said cylinder, and a rod projecting from said piston through one end of said cylinder, said one end of said cylinder defining the rod end of said cylinder and the other end of said cylinder defining the head end of said cylinder such that flow of fluid to the head end of each cylinder causes extension thereof and flow of fluid to the rod end of each cylinder causes retraction thereof, a fluid power source for supplying fluid to and from the cylinders, and including a control system comprising: at least one pair of lines for conducting fluid to and from the cylinders, one of said lines connected to the head end of one of said cylinders and the other of said lines connected to the rod end of the other of said cylinders; a pressure reducing metering valve located in and controlling one line, said pressure reducing metering valve being operable to limit pressure through said one line to said head end of said one cylinder to a predetermined maximum pressure and to permit flow from said head end of said one cylinder through said pressure reducing metering valve upon obtaining a predetermined minimum pressure in said one line, and a metering valve operable to permit flow of fluid from said rod end of said other cylinder through said other line during said swinging movement of said swing bracket only when a predetermined minimum pressure exists in one of said lines; an interconnecting line between said one and said other lines and a check valve in said interconnecting line preventing flow from the rod end of said other cylinder to the head end of said one cylinder, while permitting flow from said hydraulic power source and the head end of said one cylinder to said rod end of said other cylinder through said other line.

16. Apparatus as claimed in claim 15 wherein said one line includes as a portion thereof a supply line, said pressure reducing metering valve being mounted in said supply line to control pressure in said one line.

17. Apparatus as claimed in claim 15 including a head end drain line connected with said pressure reducing metering valve and connected at the other end to sump.

18. Apparatus as claimed in claim 15 including a drain line connected with said other line by said metering valve, said metering valve controlling the flow from said other line into said drain line.

19. Apparatus as claimed in claim 16 including a check valve in said supply line permitting flow to the head end of said cylinder through said supply line, but preventing flow from the head end of said cylinder through said supply line.

20. Apparatus as claimed in claim 16 wherein said one line includes as a portion thereof a first main intake and exhaust line connected with said supply line, a second main intake and exhaust line connected with said rod end intake line, a cross line connecting said first and second main intake and exhaust lines, a first exhaust check valve permitting flow from said cross line to said first main intake and exhaust line but preventing flow to said cross line from said first main intake and exhaust line, and a second exhaust check valve permitting flow from said cross line to said second main intake and exhaust line but preventing flow to said cross line from said second main intake and exhaust line, said frain line being connected with said cross line between said first and second exhaust check valves.

21. Apparatus as claimed in claim 16 wherein said pressure reducing metering valve is biased to a normally open position, said pressure reducing metering valve having a pilot line connected to sense the pressure in said one line between said pressure reducing metering valve and said cylinder, said pressure reducing metering valve being responsive to a predetermined maximum pressure to move to a closed position from said normally open position.

22. Apparatus as claimed in claim 15 wherein said metering valve is biased to a normally closed position, and is responsive to a predetermined pressure in said one line to move to an open position from said normally closed position.

23. Apparatus as claimed in claim 15 including a pilot line for said metering valve connected with said one line, and a second pilot line for said metering valve connected to sense the pressure in said other line.

24. Apparatus as claimed in claim 16 wherein said one line also includes an intake and exhaust line connected to said supply line and a check valve, said check valve in the connection between said supply line and intake and exhaust line and including a pilot line for said metering valve connected with said intake and exhaust line.

* * * * *